US009941079B2

(12) United States Patent
Osanai et al.

(10) Patent No.: US 9,941,079 B2
(45) Date of Patent: Apr. 10, 2018

(54) HANDLE SWITCH FOR VEHICLE

(71) Applicant: HONDA MOTOR CO., LTD., Tokyo (JP)

(72) Inventors: Takuya Osanai, Wako (JP); Yutaka Kikuchi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 5 days.

(21) Appl. No.: 15/078,131

(22) Filed: Mar. 23, 2016

(65) Prior Publication Data

US 2016/0293360 A1 Oct. 6, 2016

(30) Foreign Application Priority Data

Mar. 30, 2015 (JP) ..... 2015-070052

(51) Int. Cl.

| | |
|---|---|
| ***H01H 9/06*** | (2006.01) |
| ***H01H 25/04*** | (2006.01) |
| *H01H 23/14* | (2006.01) |
| *H01H 25/00* | (2006.01) |

(52) U.S. Cl.

CPC ..... *H01H 25/04* (2013.01); *H01H 9/06* (2013.01); *H01H 25/041* (2013.01); *H01H 23/141* (2013.01); *H01H 25/008* (2013.01); *H01H 2009/068* (2013.01); *H01H 2025/043* (2013.01); *H01H 2025/045* (2013.01); *H01H 2025/048* (2013.01)

(58) Field of Classification Search

CPC . B62M 25/04; B62K 23/02; H01H 2009/066; H01H 13/14

USPC ..... 200/61.88, 314, 341; 74/473.12, 473.33, 74/502.2, 524

See application file for complete search history.

(56) References Cited

U.S. PATENT DOCUMENTS

| | | | | |
|---|---|---|---|---|
| 2009/0079596 | A1 | 3/2009 | Naka et al. | |
| 2010/0270135 | A1* | 10/2010 | Murasawa | B60K 20/06 200/61.88 |
| 2015/0274246 | A1* | 10/2015 | Ichikawa | B62K 23/02 74/471 R |

FOREIGN PATENT DOCUMENTS

| | | | |
|---|---|---|---|
| JP | 10-199374 | A | 7/1998 |
| JP | 2005-302347 | A | 10/2005 |
| JP | 2008-16043 | A | 1/2008 |
| JP | 2009-4209 | A | 1/2009 |
| JP | 2009-76344 | A | 4/2009 |

(Continued)

*Primary Examiner* — Ahmed Saeed

(74) *Attorney, Agent, or Firm* — Birch, Stewart, Kolasch & Birch, LLP

(57) ABSTRACT

A handle switch for use on a vehicle includes a plurality of switches for operating electric devices on a vehicle. The handle switch is mounted on a switch case fixed to a handlebar of the motorcycle, wherein the plurality of switches include a composite switch having a plurality of operating directions and other switches having less operating directions than the composite switch. The composite switch is disposed on the switch in a position closer to a center of a vehicle body, and the other switches are disposed in a position between a handle grip fixed to an end of the handlebar and the composite switch. The composite switch has an operating portion is directed rearwardly of the vehicle body. The operating portion of the composite switch includes a four-way switch as a plural-direction operator projects rearwardly of the vehicle body.

12 Claims, 13 Drawing Sheets

(56) References Cited

FOREIGN PATENT DOCUMENTS

| | | | |
|---|---|---|---|
| JP | 2010-205522 | A | 9/2010 |
| JP | 2013-114777 | A | 6/2013 |

* cited by examiner

HANDLE SWITCH FOR VEHICLE

CROSS-REFERENCE TO RELATED APPLICATIONS

The present application claims priority under 35 U.S.C. 119 to Japanese Patent Application No. 2015-070052 filed Mar. 30, 2015 the entire contents of which are hereby incorporated by reference.

BACKGROUND OF THE INVENTION

1. Field of the Invention

The present invention relates to a handle switch for a vehicle. More particularly to a handle switch for a vehicle including a composite switch which is suitable for operating a navigation display device, etc.

2. Description of Background Art

Heretofore, composite switches have been known that are designed for a reduced layout space and improved operability by having a plurality of operating elements centralized in one place.

Japanese Patent Laid-Open No. 2005-302347 discloses an arrangement wherein a four-way switch is disposed outside of a centrally located push switch and a rotary switch is disposed outside of the four-way switch. Japanese Patent Laid-Open No. 1998-199374 discloses an arrangement wherein a composite switch doubling as a push switch and a four-way switch is disposed centrally and a rotary switch is disposed outside of the composite switch. Japanese Patent Laid-Open No. 2009-4209 discloses an arrangement wherein a composite switch doubling as a four-way switch and a rotary switch is disposed outside of a central push switch.

In recent years, there has been a growing demand for vehicles, not only four-wheeled vehicles but also motorcycles, which have a display device or a navigation device that can be connected to the Internet for browsing the web, and which allow the vehicle occupant to operate the display device or the navigation device while in the riding posture when the vehicle is temporarily stopped. The composite switch disclosed in prior art identified above is suitable for operating those devices. However, since the handle of the motorcycle has switches for operating electric devices including a horn, a headlight, etc., the composite switch needs to be reviewed in terms of its structure and layout if it is to be added and also in view of making itself resistant to erroneous operation.

SUMMARY AND OBJECTS OF THE INVENTION

It is an object of an embodiment of the present invention to provide a handle switch for a vehicle which will solve the problem of the above prior art and which includes a composite switch that is suitable for operating a navigation device, etc. while being harmonized with existing switches.

To achieve the above object, an embodiment of the present invention has a first feature residing in a handle switch (10) for use on a vehicle which includes a plurality of switches for operating electric devices on a vehicle (1). The handle switch (10) is mounted on a switch case (11) fixed to a handlebar (18) of the vehicle (1), wherein the plurality of switches include a composite switch (60, 70, 80) having a plurality of operating directions and other switches (12, 13, 14, 15) having less operating directions than the composite switch (60, 70, 80), the composite switch (60, 70, 80) is disposed on the switch case (11) in a position closer to a center of a vehicle body, and the other switches (12, 13, 14, 15) are disposed in a position between a handle grip (30) fixed to an end of the handlebar (18) and the composite switch (60, 70, 80).

According to an embodiment of the present invention, the composite switch (60, 70, 80) has an operating portion (60A, 70A, 80A) oriented rearwardly of the vehicle body of the vehicle (1).

According to an embodiment of the present invention, the composite switch (60, 70, 80) has an operating portion (60A, 70A, 80A) inclined outwardly in widthwise directions of the vehicle.

According to an embodiment of the present invention, the composite switch (60, 70, 80) includes a plural-direction operator (62, 71, 82) which is operable in a plurality of directions, and the plural-direction operator (62, 71, 82) projects most rearwardly of the vehicle body in the operating portion (60A, 70A, 80A) of the composite switch (60, 70, 80).

According to an embodiment of the present invention, at least one end of the plural-direction operator (62, 71, 82) of the composite switch (60, 70, 80) among the composite switch (60, 70, 80) and the other switches (12, 13, 14, 15) is in a position most spaced from an axis (Oh) of the handlebar (18).

According to an embodiment of the present invention, the directions in which the plural-direction operator (62) is operable are in an upward, downward, leftward, and rightward directions.

According to an embodiment of the present invention, the directions in which the plural-direction operator (71) is operable are in an upward, downward, leftward, and rightward directions and a direction in which the plural-direction operator (71) can be pushed in.

According to an embodiment of the present invention, the directions in which the plural-direction operator (82) is operable are in an upward, downward, leftward, and rightward directions and a direction in which the plural-direction operator (82) can be rotated.

According to an embodiment of the present invention, the composite switch (60, 70, 80) has a circular outer shape, and the composite switch (60, 70, 80) is disposed at a height superposed on the axis (Oh) of the handlebar (18) in a front elevational view of the switch case (11).

According to an embodiment of the present invention, the plurality of switches include a composite switch (60, 70, 80) having a plurality of operating directions and other switches (12, 13, 14, 15) having less operating directions than the composite switch (60, 70, 80), the composite switch (60, 70, 80) is disposed on the switch case (11) in a position closer to a center of a vehicle body, and the other switches (12, 13, 14, 15) are disposed in a position between a handle grip (30) fixed to an end of the handlebar (18) and the composite switch (60, 70, 80). Therefore, when the composite switch is operated by the thumb, the other switches are positioned in a space defined by the angle between the index finger and the thumb as they are disposed between the handle grip and the other switches. Even when the thumb operates the composite switch in many operating directions, therefore, it is less likely to interfere with the other switches. Thus, the composite switch has a high operability. As the composite switch is disposed closer to the center of the vehicle body, when the occupant of the vehicle operates the other switches, the occupant is less likely to operate the composite switch in error.

According to an embodiment of the present invention, since the composite switch (60, 70, 80) has an operating portion (60A, 70A, 80A) oriented rearwardly of the vehicle body of the vehicle (1), even if the front surface of the switch case does not face the occupant depending on the angle of the handlebar, the operability of the composite switch is high as the operating portion of the composite switch is oriented toward the occupant.

According to an embodiment of the present invention, since the composite switch (60, 70, 80) has an operating portion (60A, 70A, 80A) inclined outwardly in widthwise directions of the vehicle, the occupant can operate the composite switch easily with the thumb while gripping a handle grip.

According to an embodiment of the present invention, the composite switch (60, 70, 80) includes a plural-direction operator (62, 71, 82) which is operable in a plurality of directions, and the plural-direction operator (62, 71, 82) projects most rearwardly of the vehicle body in the operating portion (60A, 70A, 80A) of the composite switch (60, 70, 80). Consequently, when the occupant operates a navigation display device or the like with the composite switch, inasmuch as the composite switch is used to select items and move the screen in arbitrary directions, the operability of the plural-direction operator that is operated highly frequently is increased.

According to an embodiment of the present invention, since at least one end of the plural-direction operator (62, 71, 82) of the composite switch (60, 70, 80) among the composite switch (60, 70, 80) and the other switches (12, 13, 14, 15) is in a position most spaced from an axis (Oh) of the handlebar (18). Thus, the plural-direction operator is disposed in a position closest to the occupant compared with the other switches, and can be operated with greater ease.

According to an embodiment of the present invention, as the directions in which the plural-direction operator (62) is operable in upward, downward, leftward, and rightward directions, the composite switch wherein the plural-direction operator includes a four-way switch may be incorporated in the handle switch. It is thus possible to operate the plural-direction operator in a plurality of directions within a limited space on the switch case.

According to an embodiment of the present invention, as the directions in which the plural-direction operator (71) is operable in upward, downward, leftward, and rightward directions and a direction in which the plural-direction operator (71) can be pushed in, it is possible to incorporate the composite switch wherein the plural-direction operator includes a four-way switch and a push switch in the handle switch. It is thus possible to operate the plural-direction operator in a plurality of directions within a limited space on the switch case.

According to an embodiment of the present invention, as the directions in which the plural-direction operator (82) is operable in upward, downward, leftward, and rightward directions and a direction in which the plural-direction operator (82) can be rotated, it is possible to incorporate the composite switch wherein the plural-direction operator includes a four-way switch and a rotary switch in the handle switch. It is thus possible to operate the plural-direction operator in a plurality of directions within a limited space on the switch case.

According to an embodiment of the present invention, the composite switch (60, 70, 80) has a circular outer shape, and the composite switch (60, 70, 80) is disposed at a height superposed on the axis (Oh) of the handlebar (18) in a front elevational view of the switch case (11). Consequently, the area of the composite switch is reduced for thereby allowing the composite switch to be additionally placed on the switch case with ease, and the composite switch is disposed in a position where it can easily be operated by the thumb of the hand that is gripping the handlebar.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Preferred embodiments of the present invention will be described in detail below with reference to the drawings.

Figure 1:
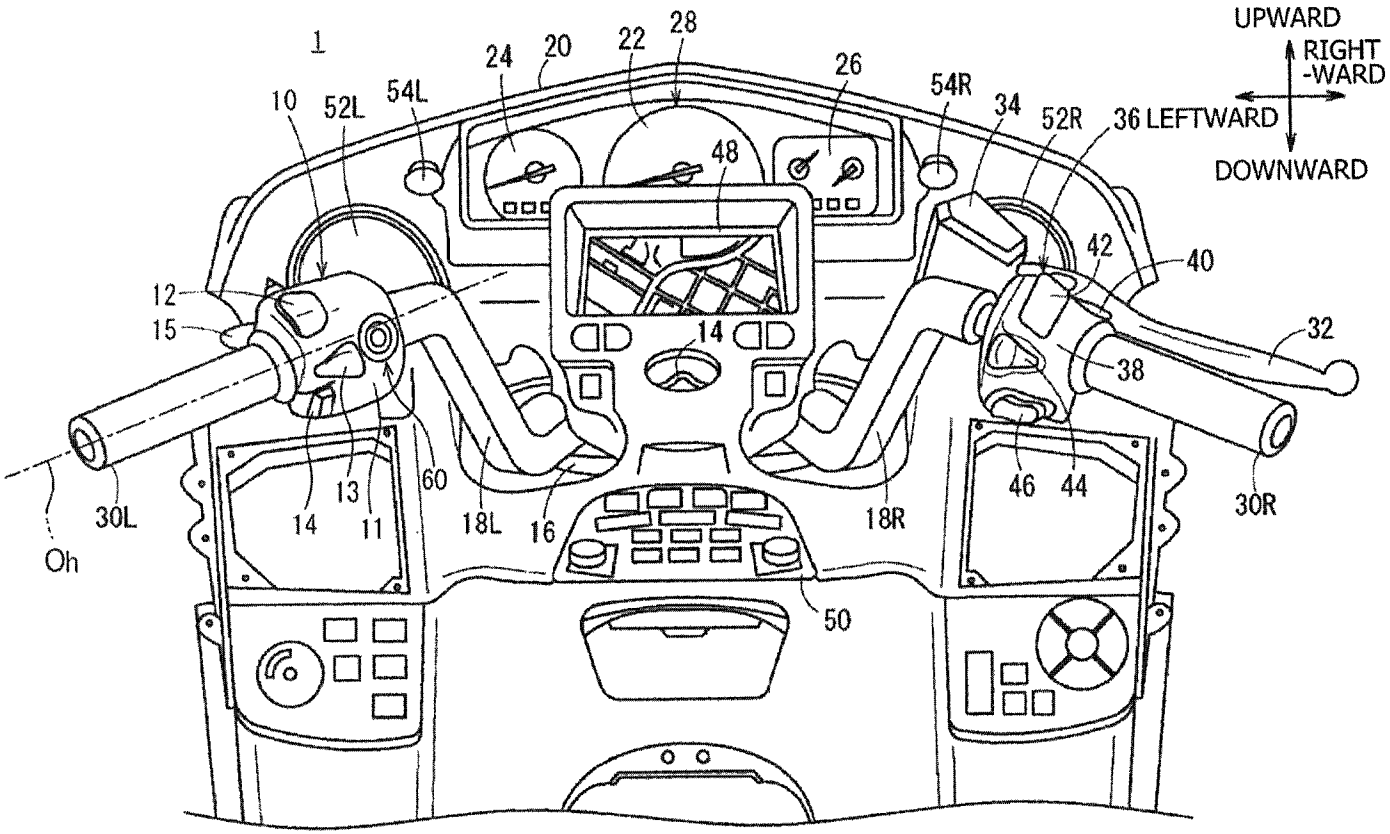
FIG. 1 is a perspective view of a meter cluster and its neighborhood of a motorcycle which incorporates a handle switch for a vehicle according to an embodiment of the present invention.

FIG. 1 is a perspective view of a meter cluster operatively connected to a motorcycle (vehicle) 1 which incorporates a handle switch 10 for a vehicle according to an embodiment of the present invention.

The motorcycle 1 has a front wheel rotatably supported on the lower ends of a pair of left and right front fork members, not shown, and the front fork members have respective upper portions fixedly coupled together by a top bridge 16 on which a main switch 14 is mounted. The top bridge 16 is angularly movably mounted on a vehicle body frame of the motorcycle 1 by a steering stem, not shown. A pair of left and right handlebars 18L and 18R for gripping by both hands of a rider to steer the front wheel are fixed to the upper ends of the front fork members.

The handlebars 18L and 18R have front sides, as viewed in terms of the vehicle body, covered with a cowling 20 as an outer covering. Within the cowling 20, there is disposed a meter cluster 28 having various instruments 26 including a tachometer 22, a speedometer 24, a fuel meter, etc.

A navigation display device 48 is disposed above the center of the top bridge 16 and behind the meter cluster 28. An audio unit 50 that functions as an FM tuner, an AM tuner, a digital audio player unit, an MD deck, a cassette deck, an amplifier, etc. is disposed behind the navigation display device 48.

The navigation display device 48 is capable of displaying web pages from the Internet instead of navigation screens. The navigation display device 48 may be replaced with a portable electronic device such as a smart phone or the like that is capable of displaying web pages from the Internet. The navigation display device 48, the audio unit 50, and the portable electronic device are arranged as electric devices on the vehicle that are operable with a handle switch to be described later.

Mid-range and bass speakers 52L and 52R for reproducing mid-range and bass sounds from the audio unit 50 are disposed on the left and right of the meter cluster 28, respectively. High-range speakers 54L and 54R are disposed between the mid-range and bass speakers 52L and 52R and the meter cluster 28.

Handle grips 30L and 30R, in the form of rubber tubes or the like, are mounted, respectively, on the handlebars 18L and 18R. A front wheel brake lever 32 is disposed on the front side, as viewed in terms of the vehicle body, of the right handle grip 30R, and a reserve tank 34 for storing working oil for a hydraulic brake system is mounted on the proximal end of the right handle grip 30R. The right handle grip 30R is supported for angular movement about the axis of the handlebar 18R. When the right handle grip 30R is angularly moved, it actuates the throttle mechanism of a power source of the motorcycle 1.

A right handle switch 36 having operation switches for operating various electric devices of the motorcycle 1 is mounted on the right handlebar 18R adjacent to the handle grip 30R. The handle switch 36 is fixed to the handlebar 18R, and the operation switches thereof are mounted on a box-shaped right switch case 38 of the handle switch 36.

The operation switches on the right switch case 38 include a travel mode selector switch 40, an engine kill switch 42, a hazard lamp switch 44, and a starter switch 46.

The handle switch 10 is mounted on the left handlebar 18L adjacent to a side of the handle grip 30L closer to the center of the vehicle body. The handle switch 10 has a box-shaped left switch case 11 made of resin or the like. On the left switch case 11, there are disposed a passing switch 15 for emitting a high beam from the headlight only when it is pressed, an optical axis selector switch 12 for switching between low and high beams from the headlight, a horn switch 13 for energizing a horn to produce a warning sound, a blinker switch 14 for operating left and right blinker devices, and a composite switch 60 for operating the navigation display device 48, the portable electronic device, or the like.

Figure 2:
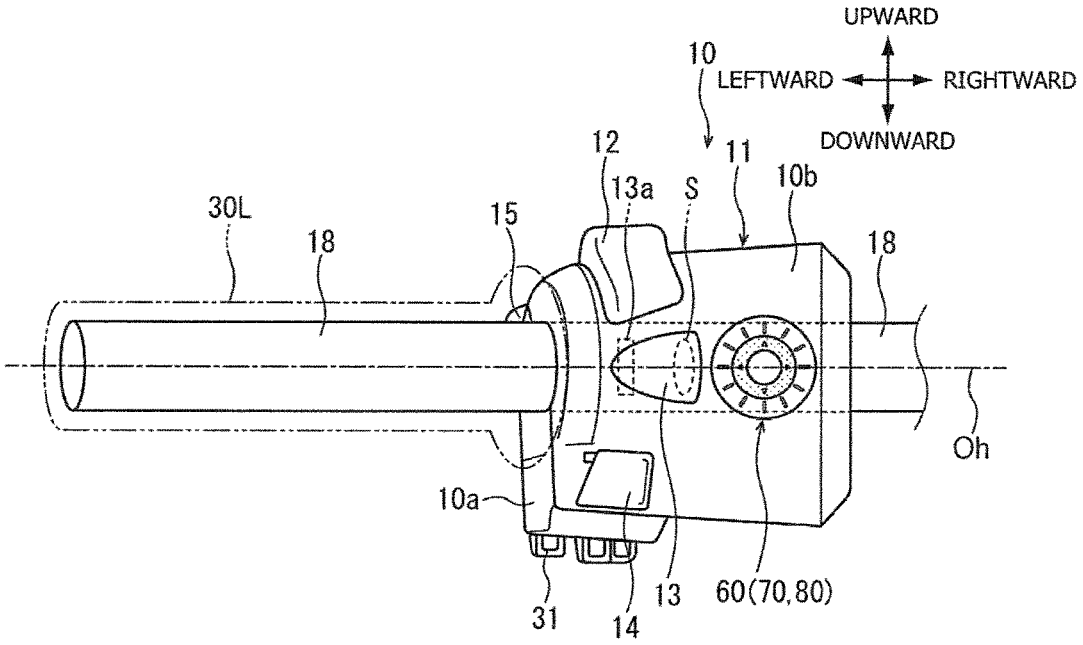
FIG. 2 is a front elevational view of the handle switch as viewed from behind a vehicle body.
Figure 3:
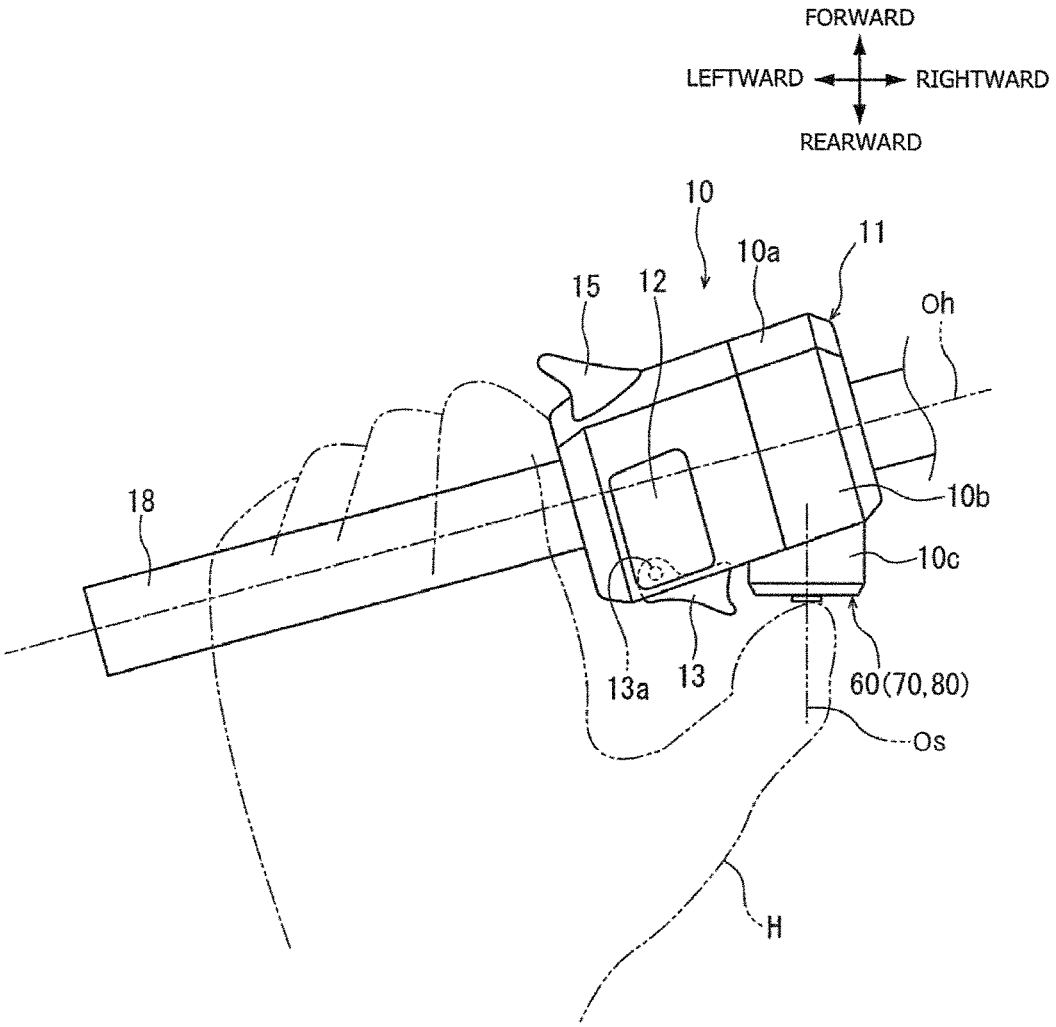
FIG. 3 is a plan view of the handle switch.
Figure 4:
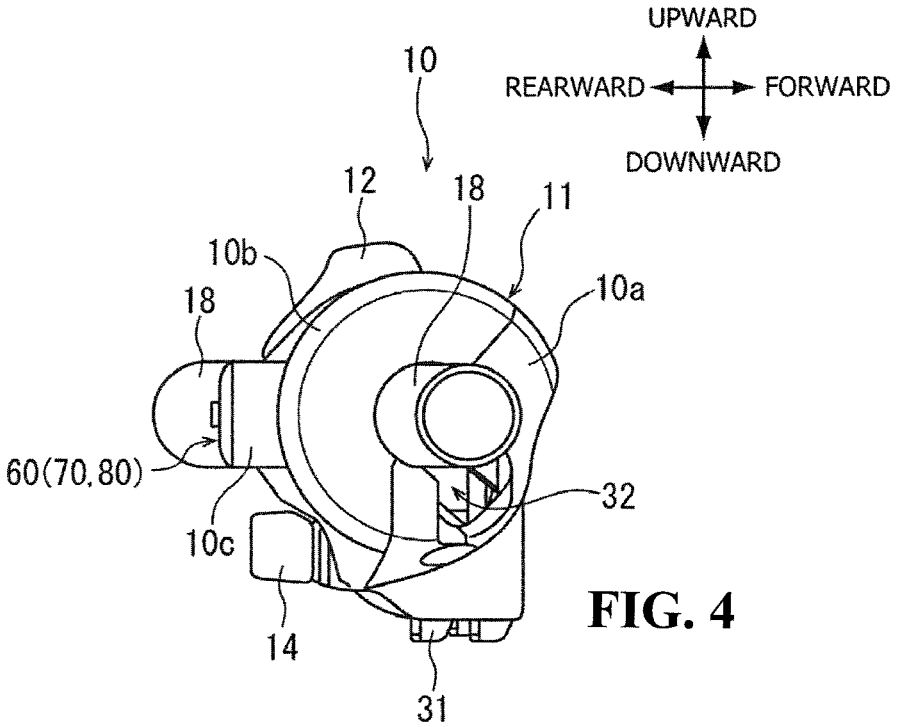
FIG. 4 is a side elevational view of the handle switch as viewed from the right side of the vehicle body.

FIG. 2 is a front elevational view of the left handle switch 10 (hereinafter simply referred to as handle switch 10) as viewed from behind the vehicle body (from the perspective of a rider). FIG. 3 is a plan view of the handle switch 10, and FIG. 4 is a side elevational view of the handle switch 10 as viewed from the right side of the vehicle body.

The switch case 11 includes a front case half 10*a* positioned forwardly as viewed in terms of the vehicle body and a rear case half 10*b* positioned rearwardly (closer to the rider) as viewed in terms of the vehicle body. The front case half 10*a* and the rear case half 10*b* of the switch case 11 sandwich therebetween the handlebar 18L (hereinafter simply referred to as handlebar 18) on its front and rear surfaces, and are fixed by the handlebar 18 by being fastened to each other by self-tapping screws or the like. The handle grip 30L (hereinafter simply referred to as handle grip 30) is fixed to a left end portion of the handlebar 18 adjacent to the switch case 11. Wires that are connected to the operation switches are led out of the front case half 10*a* through a recess 32 that is defined in a side wall of the front case half 10*a*. The front case half 10*a* has a water drain hole 31 of a labyrinth structure that is defined in the bottom of the front case half 10*a*.

The composite switch 60 is disposed in a position superposed on an axis Oh of the handlebar 18 and close to an inner side thereof (the right side as shown) along a widthwise direction of the vehicle body in a front elevational view of the switch case 11. A passing switch 15, an optical axis selector switch 12 for the headlight, a horn switch 13, and a blinker switch 14 are disposed in positions outwardly in the widthwise direction of the vehicle body from the composite switch 60, successively from the front side as viewed in terms of the vehicle body toward the rider. According to the present embodiment, of the switches disposed on the switch case 11, the switches other than the composite switch 60 are referred to as "other switches," and the switches disposed on the switch case 11 include the composite switch 60 and the other switches (12, 13, 14, and 15).

The horn switch 13 is a swingable press switch disposed at a height superposed on the axis Oh of the handlebar 18 in the front elevational view of the switch case 11, and is swingable about a swing shaft 13*a* disposed closer an outer side in the widthwise direction of the vehicle body. To operate the horn switch 13, the rider pushes an operating surface S thereof which is positioned closer to the center of the vehicle body, forwardly as viewed in terms of the vehicle body with the thumb of the left hand H.

The composite switch 60 is mounted on the rear end of a tubular protrusion 10*c* on the rear case half 10*b*, at the height superposed on the axis Oh of the handlebar 18 in the front elevational view of the switch case 11, as described above. This position of the composite switch 60 is suitable for the rider to operate it with the thumb while gripping the handlebar 18 with the left hand H. Therefore, the operability of the composite switch 60 is increased. The composite switch 60 has an axis Os oriented in the longitudinal directions of the vehicle body, so that the composite switch 60 has its operating portion 60A oriented rearwardly of the vehicle body, i.e., toward the rider. The composite switch 60 may be replaced with composite switches 70 and 80 (see FIGS. 7 through 10) according to modifications to be described later.

The composite switch 60 described below may also be replaced with the composite switches 70 and 80.

According to the present embodiment, the composite switch 60 is characterized in that it is disposed on the switch case 11 in a position closer to the center of the vehicle body and the other switches 12 through 15 are disposed in positions between the handle grip 30 and the composite switch 60. Therefore, when the composite switch 60 is operated by the thumb of the left hand H, the other switches are positioned in a space defined by the angle between the index finger and the thumb. When the thumb operates the composite switch 60 it is less likely to interfere with the other switches 12 through 15. Thus, the composite switch 60 is of high operability. As the composite switch 60 projects toward the rider at the position closer to the center of the vehicle body, when the rider operates the other switches 12 through 15, there is a reduced possibility of the rider erroneously operating the composite switch 60.

Figure 5:
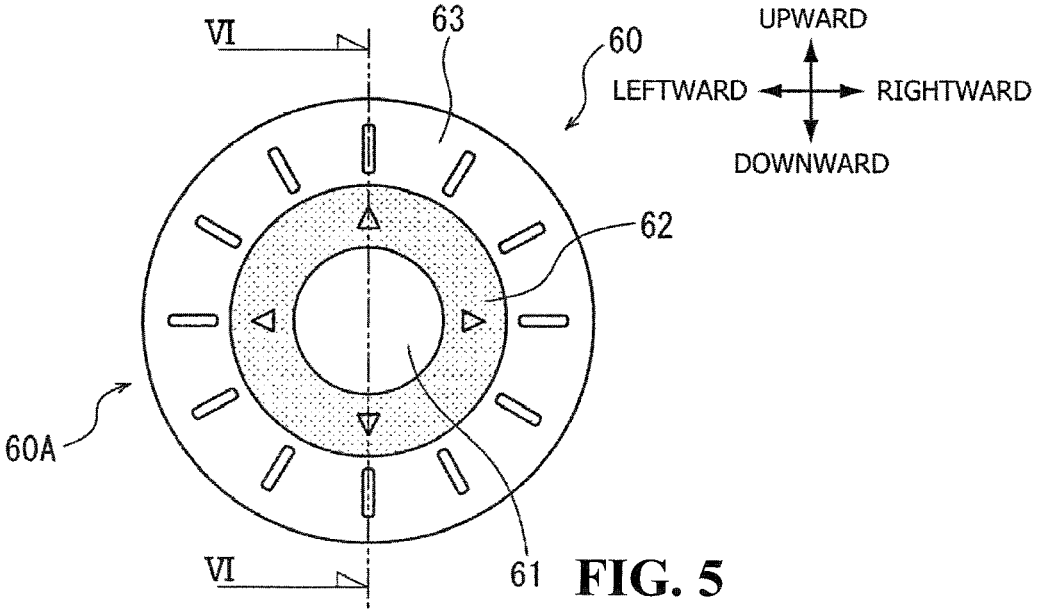
FIG. 5 is a front elevational view of a composite switch.
Figure 6:
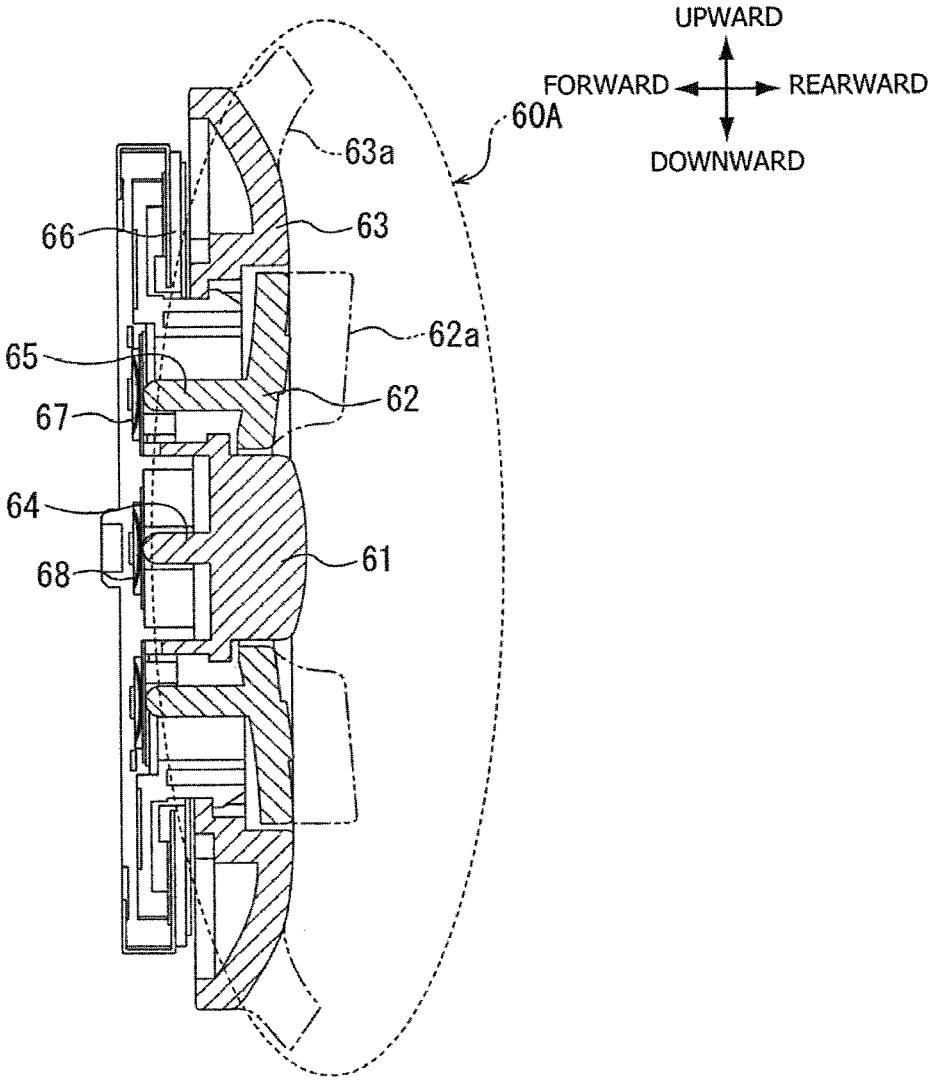
FIG. 6 is a cross-sectional view taken along line VI-VI of FIG. 5.

FIG. 5 is a front elevational view of the composite switch 60 and FIG. 6 is a cross-sectional view taken along line VI-VI of FIG. 5. The composite switch 60 has a circular outer shape as viewed in a front elevation view, and includes a circular push switch 61, an annular four-way switch 62, and an annular rotary switch 63 which are concentrically disposed.

More specifically, with regard to the operation of the navigation display device 48 or the like, the four-way switch 62, which is indicative of the upward, downward, leftward, and rightward directions and which is used to select items and move the screen in an arbitrary direction, is disposed outside of the push switch 61 that is used to decide on selected items. The rotary switch 63, which is used to select items and scale up and down the screen, is disposed outside of the four-way switch 62.

The push switch 61 is a press switch for energizing a contact 68 through a projection 64 formed on its back surface. The four-way switch 62 is a press switch for energizing contacts 67 through projections 65 formed on its back surface. The rotary switch 63 is a rotational switch for detecting rotary movement thereof with a rotary signal detector 66. In the composite switch 60, the four-way switch 62 is referred to as a plural-direction operator that is used to select a plurality of directions.

When the navigation display device 48 or the like is operated, the frequency with which the four-way switch 62 as the plural-direction operator is operated is considered to increase. As shown in FIG. 6, the four-way switch 62 may be provided with extensions 62*a* that project most toward the rider (rearwardly of the vehicle body) in the operating portion 60A of the composite switch 60 for higher operability. Extensions on the operator may be modified in a variety of designs. For example, the rotary switch 63 may have extensions 63*a* projecting in outer circumferential directions for increasing the operability of the rotary switch 63.

According to the present embodiment, the outer shape of the composite switch 60 is circular to reduce the area of the operating portion 61A for thereby allowing the composite switch 60 to be additionally placed on the switch case 11 with ease, and the composite switch 60 is disposed in the position superposed on the axis Oh of the handlebar 18 in the front elevational view of the switch case 11 for thereby increasing the operability with the thumb of the left hand H. However, the outer shape of the composite switch 60 may be modified in a variety of designs, and may be, for example, elliptical or polygonal.

Figure 7:
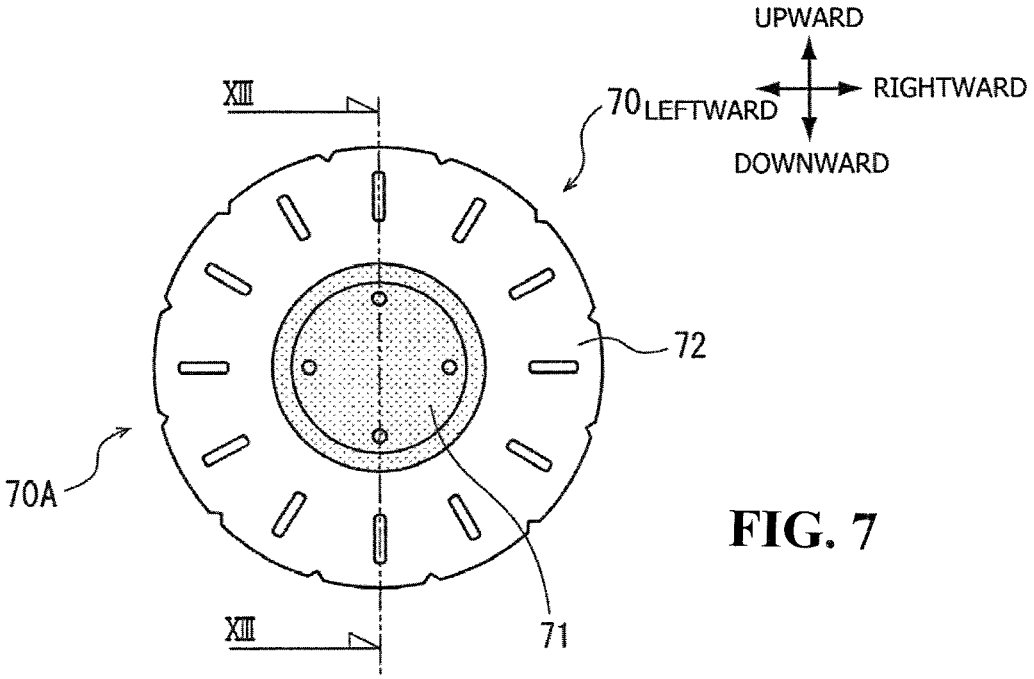
FIG. 7 is a front elevational view of a composite switch according to a modification.
Figure 8:
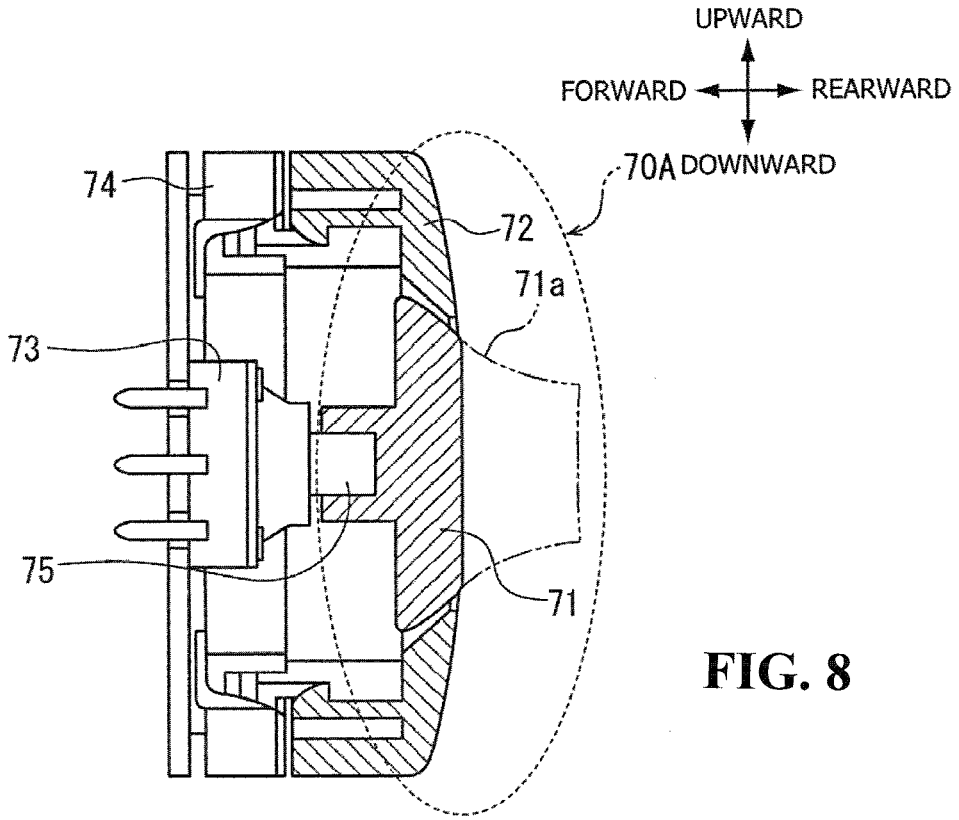
FIG. 8 is a cross-sectional view taken along line VIII-VIII of FIG. 7.

FIG. 7 is a front elevational view of a composite switch 70 according to a modification and FIG. 8 is a cross-sectional view taken along line VIII-VIII of FIG. 7. The composite switch 70 has a circular outer shape as viewed in front elevation, and includes a circular four-way switch and push switch 71 and an annular rotary switch 72 that are concentrically disposed.

The four-way switch and push switch 71 is a switch that can be pressed forwardly of the vehicle body while an operation shaft 75 projecting from a switch unit 73 thereof is being tilted in four directions. The rotary switch 72 is a rotational switch for detecting rotary movement with a rotary signal detector 74. In the composite switch 70, the four-way switch and push switch 71 is referred to as a plural-direction operator that is used to select a plurality of directions.

According to the present modification, the four-way switch and push switch 71 is provided with an extension 71*a* whose end face projects most toward the rider in an operating portion 70A of the composite switch 70 for increasing the operability of the four-way switch and push switch 71.

Figure 9:
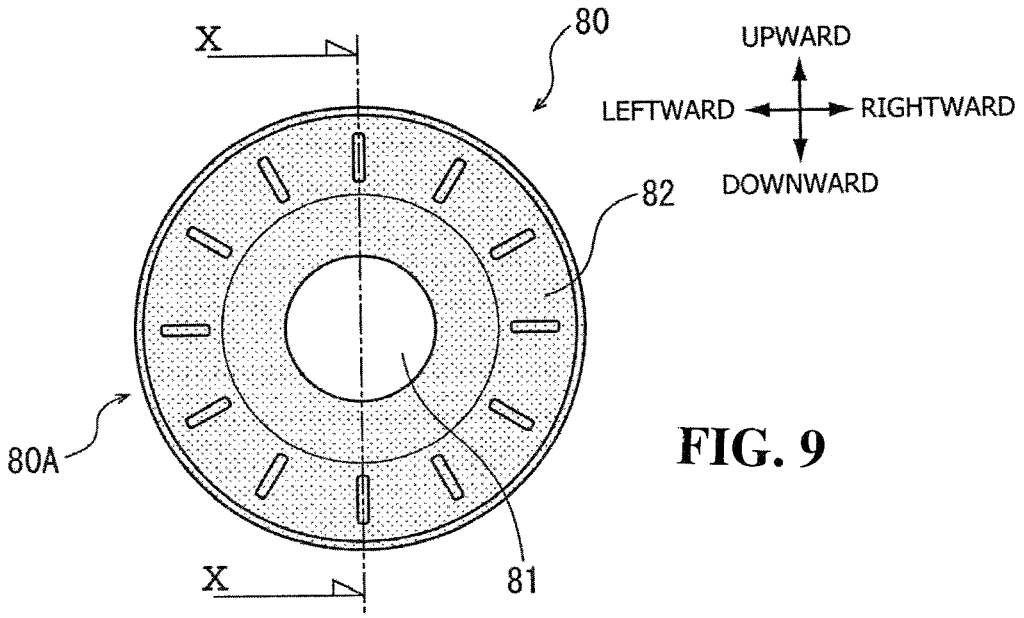
FIG. 9 is a front elevational view of a composite switch according to a second modification.
Figure 10:
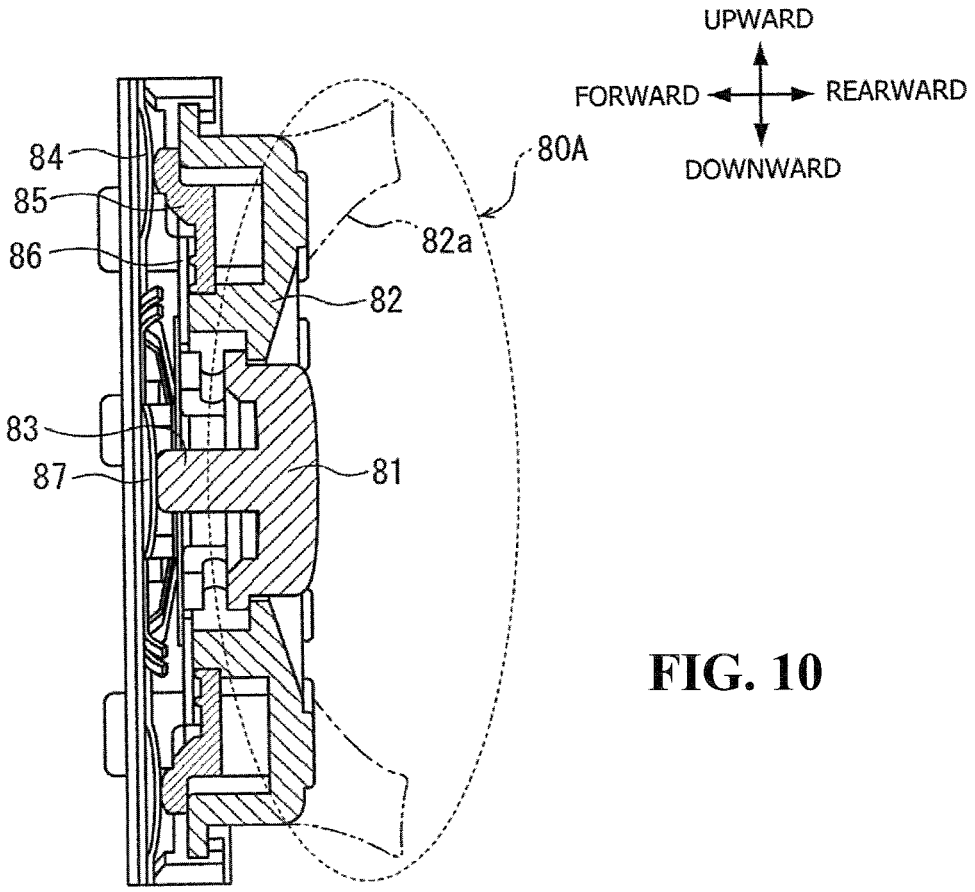
FIG. 10 is a cross-sectional view taken along line X-X of FIG. 9.

FIG. 9 is a front elevational view of a composite switch 80 according to a second modification and FIG. 10 is a cross-sectional view taken along line X-X of FIG. 9. The composite switch 80 has a circular outer shape as viewed in a front elevation, and includes a circular push switch 81 and a four-way switch and rotary switch 82 that are concentrically disposed.

The push switch 81 is a press switch for energizing a contact 87 through a projection 83 formed on its back surface. The four-way switch and rotary switch 82 is a rotational switch for transmitting rotary motion of the rotary switch 82 to a rotary signal detector 86 with contactors 85 disposed on the back surface of an operator, and also a press switch for energizing contacts 84 by pressing the contactors 85. In the composite switch 80, the four-way switch and rotary switch 82 is referred to as a plural-direction operator that is used to select a plurality of directions.

According to the present modification, the four-way switch and rotary switch 82 has extensions 82*a* whose end faces project most toward the rider in an operating portion 80A of the composite switch 80 for increasing the operability of the four-way switch and rotary switch 82.

Figure 11:
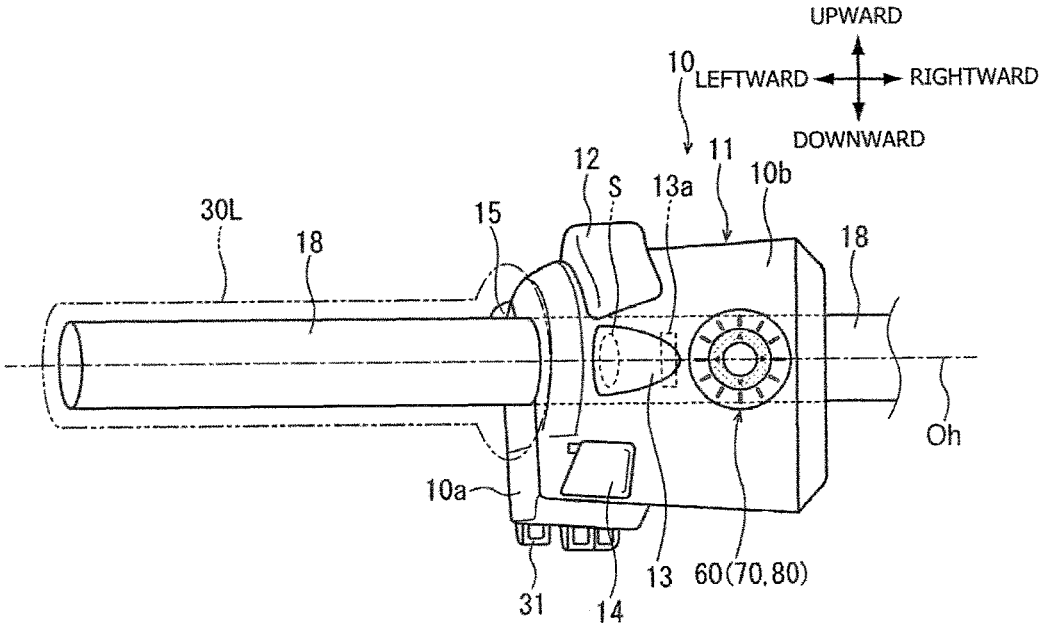
FIG. 11 is a front elevational view of a handle switch with the composite switch disposed in a layout according to a modification.
Figure 12:
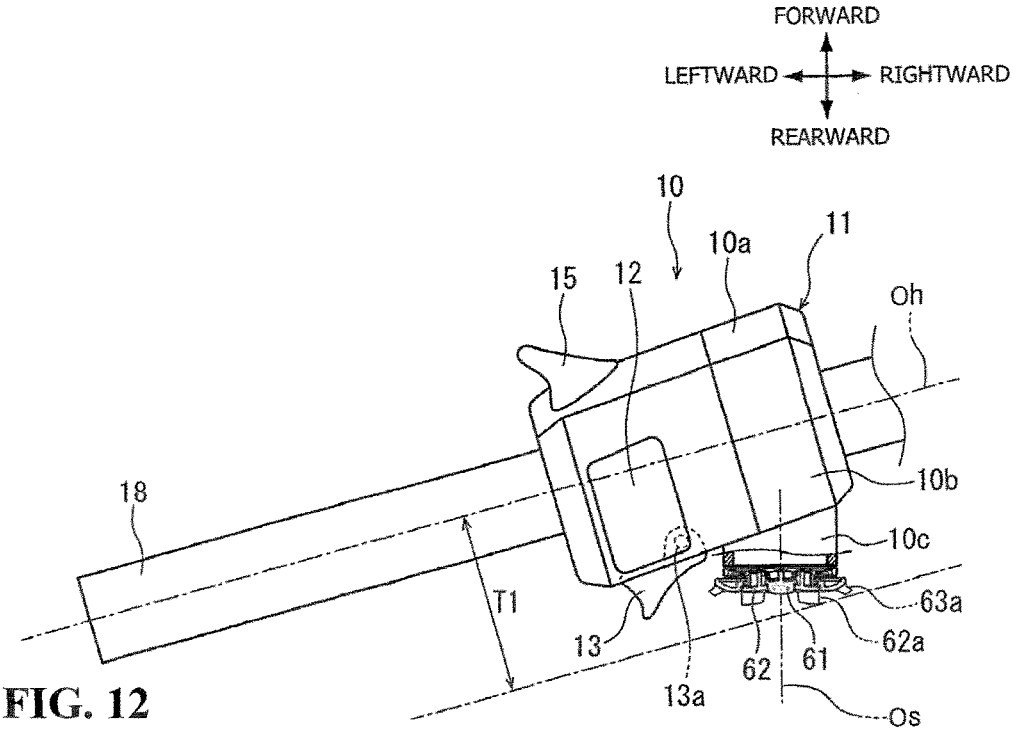
FIG. 12 is a plan view of a handle switch with the composite switch disposed in the layout.
Figure 13:
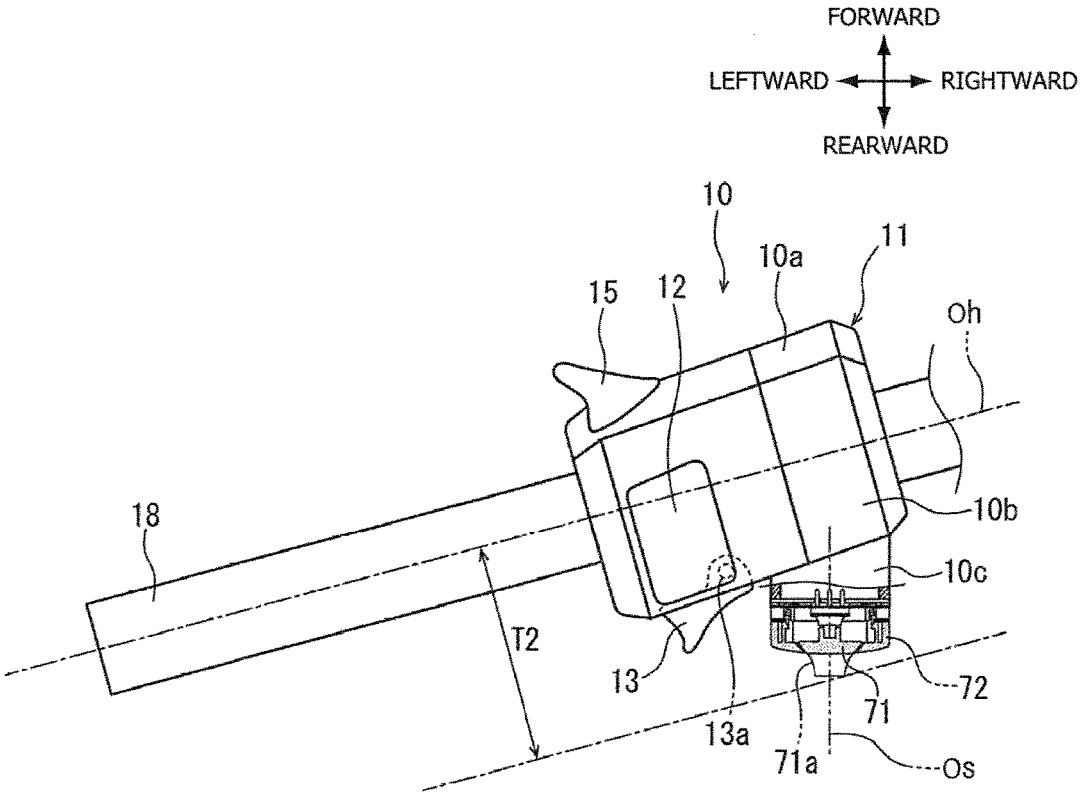
FIG. 13 is a plan view of a handle switch with the composite switch according to the modification disposed in the layout.
Figure 14:
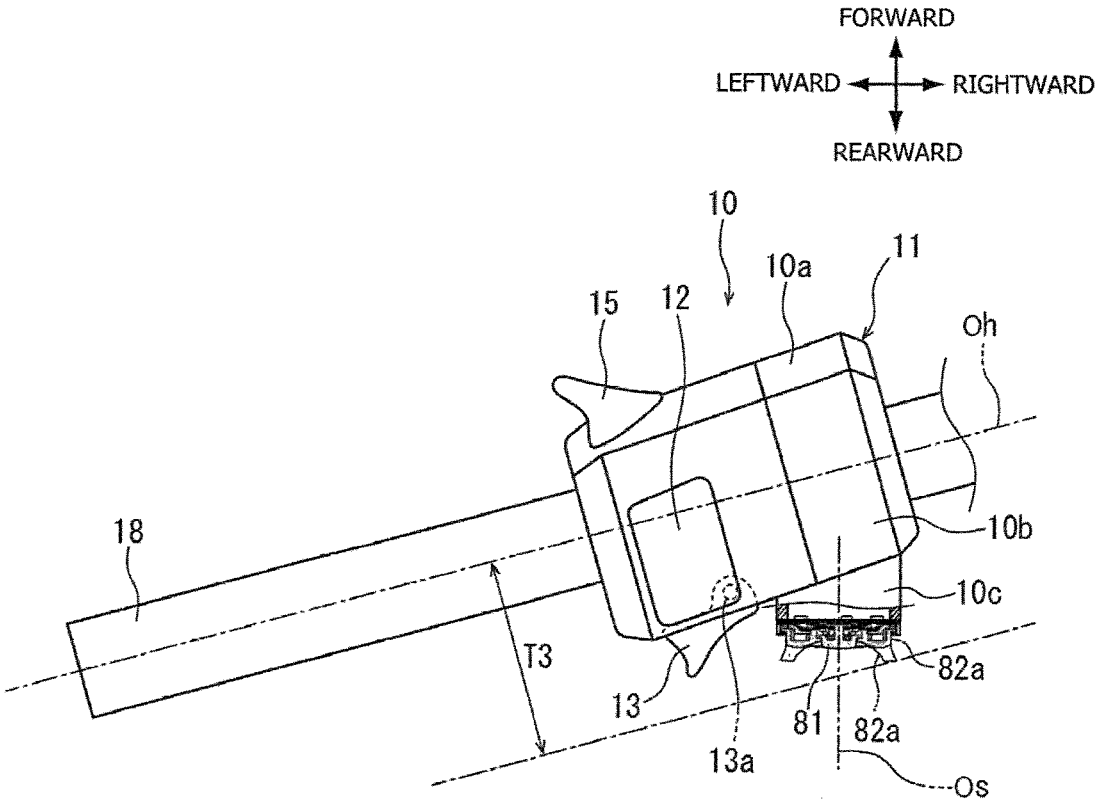
FIG. 14 is a plan view of a handle switch with the composite switch according to the second modification disposed in the layout.

FIG. 11 is a front elevational view of a handle switch 10 with the composite switch 60 disposed in a layout according to a modification. FIGS. 12, 13, and 14 are plan views of the handle switch 10 with the composite switches 60, 70, and 80 disposed in the layout.

The horn switch 13 of the handle switch 10 shown in FIGS. 2 through 4 is of a structure wherein the swing shaft 13*a* is disposed closer to the outer side in the widthwise direction of the vehicle body and the horn switch 13 is swung when the operating surface S positioned closer to the center of the vehicle body is pressed. According to the present modification, the swing shaft 13*a* of the horn switch 13 is positioned closer to the center of the vehicle body and the operating surface S is closer to the outer side in the widthwise direction of the vehicle body, so that the thumb is much less likely to touch the composite switch 60 (70 or 80) when it operates the horn switch 13.

As shown in FIG. 12, in the case where the composite switch 60 is mounted on the protrusion 10*c*, the end of one of the extensions 62*a* of the four-way switch 62 as the plural-direction operator is disposed in a position that is spaced a distance T1 from the axis Oh of the handle bar 18. Therefore, the extension 62*a* is most spaced from the axis Oh compared to the other switches 12, 13, 14, and 15, allowing the rider to operate the four-way switch 62 with greater ease. Furthermore, since the operating surface S of the horn switch 13 is positioned closer to the outer side in the widthwise directions of the vehicle body, the extensions 63*a* of the rotary switch 63*a* do not interfere with the horn switch 13.

As shown in FIG. 13, in the case where the composite switch 70 is mounted on the protrusion 10*c*, the end of the extension 71*a* of the four-way switch and push switch 71 as the plural-direction operator is disposed in a position that is spaced a distance T2 from the axis Oh of the handle bar 18. Therefore, the extension 71*a* is most spaced from the axis Oh compared to the other switches 12, 13, 14, and 15, allowing the rider to operate the four-way switch and push switch 71 with greater ease.

As shown in FIG. 14, in the case where the composite switch 80 is mounted on the protrusion 10*c*, the end of one of the extensions 82*a* of the four-way switch and rotary switch 82 as the plural-direction operator is disposed in a position that is spaced a distance T3 from the axis Oh of the handle bar 18. Therefore, the extension 82*a* is spaced the most from the axis Oh compared to the other switches 12, 13, 14, and 15, allowing the rider to operate the four-way switch and rotary switch 82 with greater ease.

Figure 15:
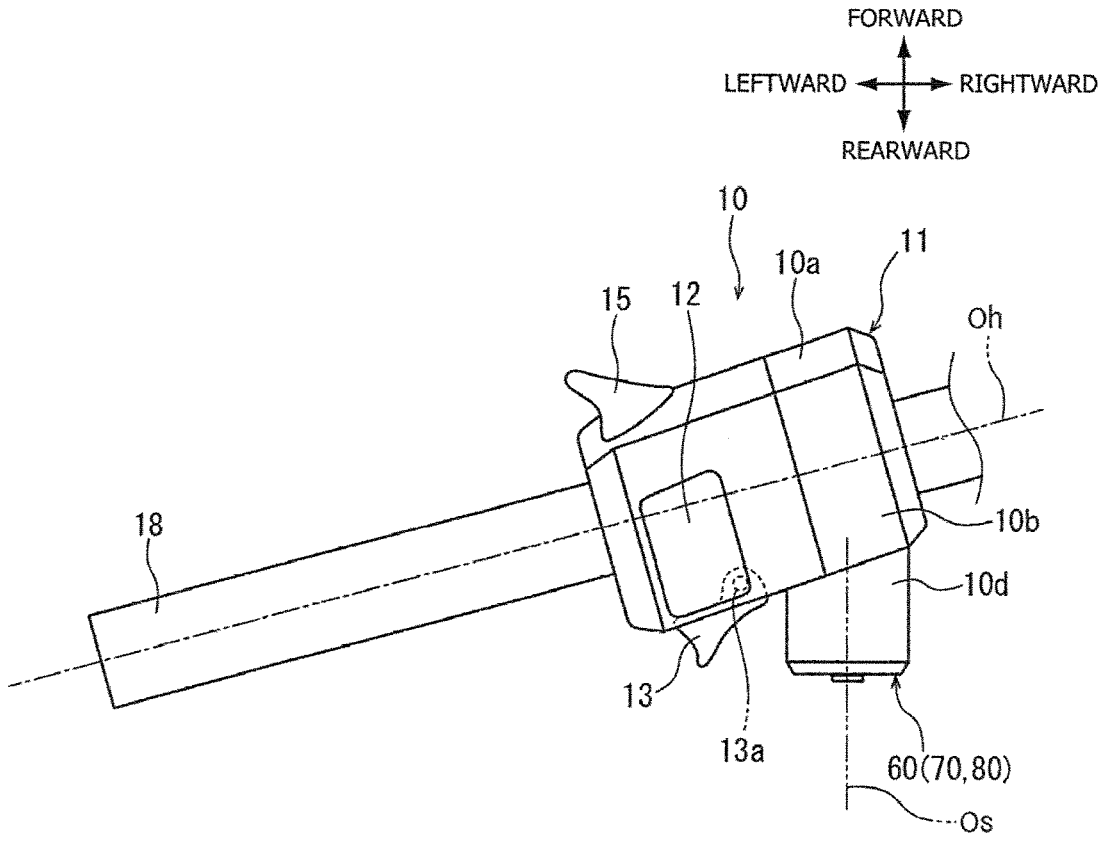
FIG. 15 is a plan view of a handle switch with the composite switch disposed in a layout according to a second modification.

FIG. 15 is a plan view of a handle switch 10 with the composite switch disposed in a layout according to a second modification. The present modification is characterized in that a tubular protrusion 10*d* that supports the composite switch 60 is extended to bring the composite switch 60 closer to the rider. With this structure, even when the thumb that operates the horn switch 13 is shifted closer to the center of the vehicle body, it only interferes with the side surface of the protrusion 10*d*, and the possibility of the thumb touching the composite switch 60 is reduced.

Figure 16:
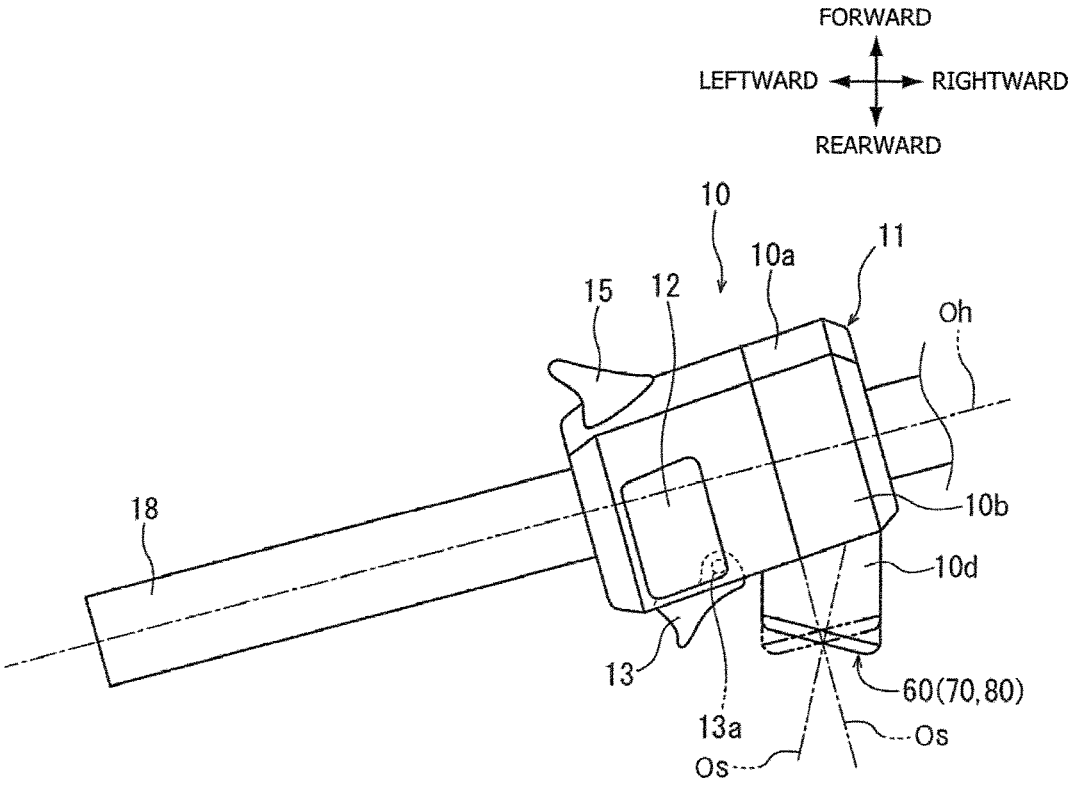
FIG. 16 is a plan view of a handle switch with the composite switch disposed in a layout according to a third modification.

FIG. 16 is a plan view of a handle switch 10 with the composite switch disposed in a layout according to a third modification. The present modification is characterized in that the protrusion 10*d* is extended and also the axis Os of the composite switch 60 deviates from the longitudinal directions of the vehicle body. According to the present modification, the operating portion 60A of the composite switch 60 may lie parallel to the surface of the switch case 11 of the handle switch 10 or may be directed slightly inwardly in the widthwise directions of the vehicle body. This modification is applicable depending on the structure of the switch case 11 or other different switches.

Figure 17:
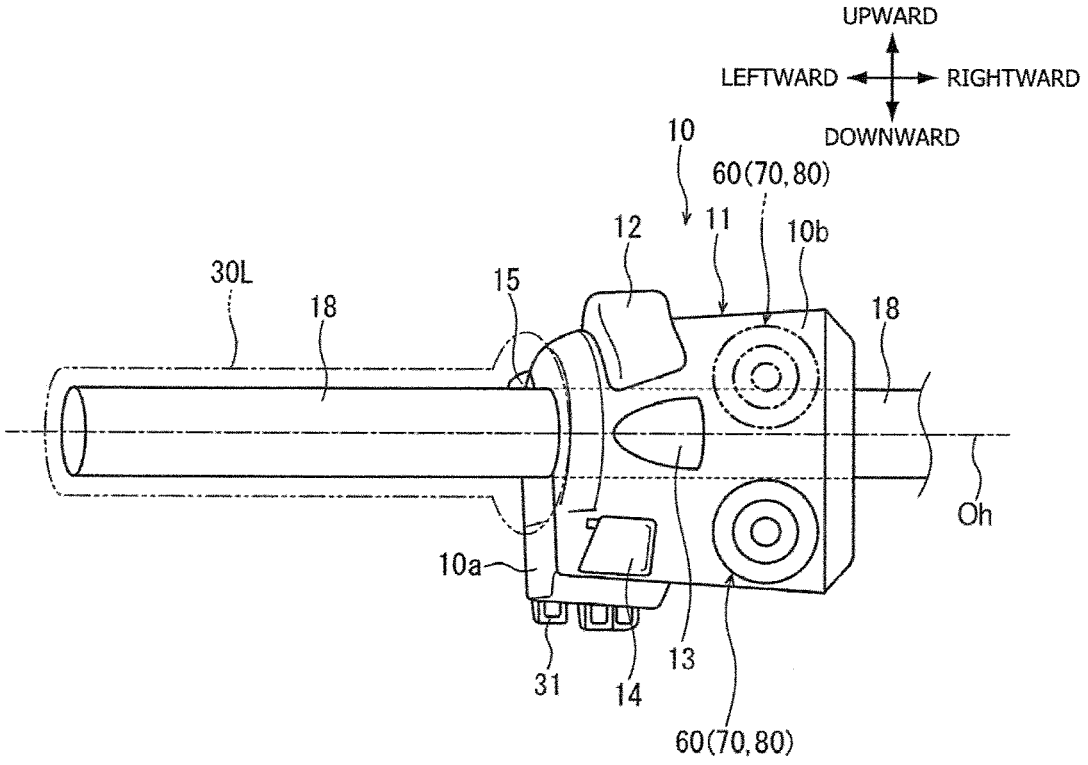
FIG. 17 is a front elevational view of a handle switch with the composite switch disposed in a layout according to a fourth modification.

FIG. 17 is a front elevational view of a handle switch 10 with the composite switch disposed in a layout according to a fourth modification. In the above embodiment, the composite switch 60 is disposed at a height superposed on the axis Oh of the handlebar 18 in the front elevational view of the switch case 11. On the other hand, the present modification is characterized in that the composite switch 60 is offset upwardly or downwardly from the axis Oh. In the illustrated example, since the composite switch 60 is offset upwardly or downwardly from the axis Oh, the possibility that the horn switch 13 positioned in superposed relation to the axis Oh will be operated in error when the composite switch 60 is operated is reduced. This modification is applicable depending on the structure of the switch case 11 or other different switches. In the above embodiment, the composite switch 60 is positioned in the range within the outer shape of the switch case 11 the front elevational view of the switch case 11. However, the composite switch 60 may be positioned so as to protrude wholly or partly from the switch case 11.

The configuration of the motorcycle, the shapes and structures of the handle switch and the switch case, the function and structure of the composite switch, the operators and shape of the composite switch, the shape of the extension on each operator, the types of the device and function that are operated by the composite switch, and the shapes and functions of the other switches are not limited to the above embodiments, but may be modified in various ways. For example, the composite switch may be mounted on the right handle switch on the right handlebar of the vehicle. The handle switch for the vehicle according to the present invention is not limited to use on the motorcycle, but may be applied to various vehicles such as saddle-type three- or four-wheeled vehicles or the like.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A handle switch for use on a vehicle which includes a plurality of switches for operating electric devices on the vehicle, said handle switch being mounted on a switch case fixed to a handlebar of said vehicle, comprising:

said plurality of switches include a composite switch having a plurality of operating directions and other switches having less operating directions relative to said composite switch;

said composite switch being disposed on said switch case in a position closer to a center of a vehicle body;

the composite switch and one of said other switch are disposed at a height superposed on an axis (Oh) of the handlebar in a front elevational view of the switch case: and said other switches being disposed in a position between a handle grip fixed to an end of said handlebar and said composite switch;

said composite switch including an operating portion oriented rearwardly of a vehicle body of said vehicle:

said composite switch includes a plural-direction operator which is operable in a plurality of directions: and said plural-direction operator projects most rearwardly of the vehicle body in the operating portion of said composite switch:

wherein said plural-direction operator is operable in an upward, downward, leftward, and rightward directions;

wherein at least one end of the plural-direction operator of said composite switch, as compared to said other switches, is in a position spaced a greater distance away from the axis of said handlebar.

2. The handle switch for use on a vehicle according to claim 1, wherein said composite switch has the operating portion is inclined outwardly in widthwise directions of the vehicle.

3. The handle switch for use on a vehicle according to claim 1, wherein said plural-direction operator is operable in the upward, downward, leftward, and rightward directions and in a direction wherein said plural-direction operator can be pushed in to actuate.

4. The handle switch for use on a vehicle according to claim 1, wherein said plural-direction operator is operable in the upward, downward, leftward, and rightward directions and a direction in which said plural-direction operator can be rotated.

5. The handle switch for use on a vehicle according to claim 1, wherein:

said composite switch has a circular outer shape; and said composite switch is disposed at a height superposed on the axis of said handlebar in a front elevational view of said switch case.

6. A handle switch for use on a vehicle comprising:

a plurality of switches for operating electric devices on the vehicle;

a switch case for mounting said handle switch to a handlebar of said vehicle;

said plurality of switches including a composite switch having a plurality of operating directions and other switches having less operating directions relative to said composite switch;

a handle grip fixed to an end of said handlebar;

said composite switch being disposed on said switch case in a position closer to a center of a vehicle body;

said other switches being disposed in a position between said handle grip and said composite switch;

said composite switch includes a plural-direction operator which is operable in a plurality of directions: and said plural-direction operator projects most rearwardly of the vehicle body in an operating portion of said composite switch:

wherein said plural-direction operator is operable in an upward, downward, leftward, and rightward directions;

wherein at least one end of the plural-direction operator of said composite switch, as compared to said other switches, is in a position spaced a greater distance away from an axis of said handlebar.

7. The handle switch for use on a vehicle according to claim 6, wherein said composite switch has the operation portion is oriented rearwardly of the vehicle body of said vehicle.

8. The handle switch for use on a vehicle according to claim 6, wherein said composite switch has the operating portion is inclined outwardly in widthwise directions of the vehicle.

9. A handle switch for use on a vehicle which includes a plurality of switches for operating electric devices on the vehicle, said handle switch being mounted on a switch case fixed to a handlebar of said vehicle, comprising:

said plurality of switches include a composite switch having a plurality of operating directions and other switches having less operating directions relative to said composite switch;

said composite switch being disposed on said switch case in a position closer to a center of a vehicle body;

said other switches being disposed in a position between a handle grip fixed to an end of said handlebar and said composite switch;

wherein said composite switch has an operating portion oriented rearwardly of a vehicle body of said vehicle;

said composite switch has a circular outer shape; and said composite switch is disposed at a height superposed on an axis of said handlebar in a front elevational view of said switch case;

wherein at least one end of the plural-direction operator of said composite switch, as compared to said other switches, is in a position spaced a greater distance away from the axis of said handlebar.

10. The handle switch for use on a vehicle according to claim 9, wherein said composite switch has the operating portion is inclined outwardly in widthwise directions of the vehicle.

11. The handle switch for use on a vehicle according to claim 9, wherein said plural-direction operator is operable in the upward, downward, leftward, and rightward directions and in a direction wherein said plural-direction operator can be pushed in to actuate.

12. The handle switch for use on a vehicle according to claim 9, wherein said plural-direction operator is operable in the upward, downward, leftward, and rightward directions and a direction in which said plural-direction operator can be rotated.

* * * * *